United States Patent [19]

Dielacher et al.

[11] 4,290,881

[45] Sep. 22, 1981

[54] PROCESS FOR THE SEPARATION OF UNSATURATED COMPOUNDS FROM LIQUID HYDROCARBON MIXTURES

[75] Inventors: Maximillian Dielacher, Hamburg; Uwe Hansen, Jesteburg, both of Fed. Rep. of Germany

[73] Assignee: Deutsche Texaco Aktiengesellschaft, Hamburg, Fed. Rep. of Germany

[21] Appl. No.: 37,805

[22] Filed: May 10, 1979

Related U.S. Application Data

[63] Continuation of Ser. No. 799,634, May 23, 1977, abandoned.

[51] Int. Cl.[3] ..... C10G 25/02

[52] U.S. Cl. ..... 208/310 R; 585/820; 585/826

[58] Field of Search ..... 208/310 R; 585/820, 585/826

[56] References Cited

U.S. PATENT DOCUMENTS

| | | | |
|---|---|---|---|
| 2,487,805 | 11/1949 | Hermanson | 208/310 R |
| 2,574,434 | 11/1951 | Greentree | 208/310 R |
| 3,409,691 | 11/1968 | Small | 208/310 R |
| 3,922,217 | 11/1975 | Cohen et al. | 208/310 R |

*Primary Examiner*—Delbert E. Gantz
*Assistant Examiner*—William Leader
*Attorney, Agent, or Firm*—Carl G. Ries; Robert Knox, Jr.

[57] ABSTRACT

Unsaturated compounds are separated from liquid hydrocarbon mixtures by adsorbing the unsaturated compounds on a macroporous cation exchange resin and desorbing the unsaturated compounds with a mononuclear aromatic compound.

13 Claims, No Drawings

PROCESS FOR THE SEPARATION OF UNSATURATED COMPOUNDS FROM LIQUID HYDROCARBON MIXTURES

This is a continuation, of application Ser. No. 799,634, filed May 23, 1977, now abandoned.

BACKGROUND OF THE INVENTION

The invention relates to a process for the separation of one or more olefinic or aromatic unsaturated compounds from a liquid, paraffin-rich hydrocarbon mixture. The invention enables unsaturated compounds to be almost completely separated from liquid hydrocarbon mixtures whose components have only slight physical and chemical differences from each other. The invention is particularly, but not exclusively, applicable to the separation of aromatic hydrocarbons from hydrocarbon mixtures which consist almost wholly of paraffin.

The separation of unsaturated compounds from paraffin-rich hydrocarbon mixtures is known and has been carried out for a long time by treating the crude hydrocarbon mixture with a liquid, such as concentrated sulphuric acid or a selective solvent, such as liquid sulfur dioxide or furfural. To achieve almost complete separation of the unsaturated compounds, however, the known refining processes involve considerable outlay. For economic reasons these processes are therefore usually only used for the primary purification of crude hydrocarbon mixtures.

Liquid hydrocarbon mixtures which contain only small amounts of unsaturated compounds can be further purified in an economic way, as is well known, by treating with solid adsorption agents. Thus, for example, the German Offenlegungsschrift P 22 52 305.3 discloses a process for the production of purified n-paraffins in which a technically accessible n-paraffin mixture is freed of carcinogenic polycyclic aromatic hydrocarbons by treatment with a certain aluminum-oxide adsorption agent to such an extent that the purified n-paraffins can be used for the production of biogenic proteins for use in foodstuffs. In this process the crude n-paraffins mixtures are passed through a fixed-bed of the adsorption agent. However, it is difficult and costly to completely free the adsorption agent again from the aromatic compounds bound therein and to regenerate it for renewed use.

U.S. Pat. No. 3,409,691 relates to another process wherein the separation of mixtures containing substances of different polarity is performed using dehydrated macroporous cation exchange resins in the form of their metal salts as selective adsorption agents. However this U.S. patent makes as little mention of economic regeneration of the used exchange resin as it does of separation, in particular of polycyclic aromatic compounds which are contained in only small amounts in a starting material substantially consisting of higher paraffins.

East German Pat. No. 62 385 discloses a process by means of which polycyclic aromatics and other contaminating substances can be removed from crude oil paraffins (slack wax) by adsorption on zeolitic molecular sieves.

Our U.S. Pat. No. 3,960,703 (equivalent to German Offenlegungsschrift No. 23 64 333) describes a process for the purification of crude oil paraffin (slack wax) in which the liquified starting material is treated with a dehydrated macroporous ion exchange resin which is charged almost completely with metal ions, in particular silver or copper ions, and which is expediently arranged as a fixed-bed in a column. This process supplies a product which fulfills the purity requirements of the German Manual for Pharmacists and Pharmaceutical Industry (DAB VII-Deutsche Arzneibuch VII) and which is therefore suitable for biogenic protein synthesis, for pharmaceutical and cosmetic purposes as well as for use in the food industry. However, the regeneration of the ion exchange resin used for separation is relatively involved, since the ion exchange resin must be rinsed with an inert hydrocarbon, thereafter treated with an alcohol, ether or ketone in order to desorb the separated aromatics and finally rinsed again with an inert hydrocarbon and dried.

Our U.S. Pat. No. 3,979,280 (equivalent to German Auslegeschrift No. 23 64 306) describes and claims a process for the separation of unsaturated olefinic or aromatic compounds from liquid hydrocarbon mixtures containing them wherein the physical-chemical properties of the components of the mixture differ only slightly or wherein only traces of the unsaturated compounds occur in the mixture, which comprises adsorbing the unsaturated compounds on a macroporous, dehydrated cation exchange resin laden with a metal ion and having a specific surface area of at leat 1 $m^2$/gram and a pore diameter greater than 10 A, and, subsequently, displacing the unsaturated compounds using a normally gaseous hydrocarbon.

The process of U.S. Pat. No. 3,979,280 simplifies the process of U.S. Pat. No. 3,960,703 in that the unsaturated compounds of the ion exchange resin are desorbed and displaced in U.S. Pat. No. 3,979,280 at temperature of 10° to 40° C. and pressures of 1 to 30 atmospheres by employing a normally gaseous hydrocarbon in the liquid phase as the desorption agent. Liquified propene or butene are disclosed as preferred desorption agents. In this process the exchange resin used for separating unsaturated compounds is rinsed once only with an inert hydrocarbon and is thereafter desorbed with the liquified olefin. The desorption agent is then allowed to evaporate. A second rinsing of the exchange resin can be dispensed with in this way. However, a disadvantage of this process is that this process must be carried out at excess pressure and the liquified olefins used for desorption sometimes tend to form polymers, which can impair the regenerability of the exchange resin.

It is advantageous to further simplify and improve processes for separating unsaturated compounds, in particular polycyclic aromatic hydrocarbons, from paraffin-rich hydrocarbon mixtures by treating with dehydrated macroporous cation exchange resins in form of their metal salts.

SUMMARY OF THE INVENTION

We have found that the process of separating unsaturated hydrocarbons from paraffin-rich hydrocarbons by use of a macroporous cation exchange resin can be substantially improved by employing one or more mononuclear aromatic hydrocarbons as the desorption agent.

DESCRIPTION OF THE PREFERRED EMBODIMENTS

In accordance with the present invention, there is provided a process for the separation of unsaturated compounds from a liquid, paraffin-rich hydrocarbon mixture comprising:

(a) contacting the hydrocarbon mixture with a dehydrated, macroporous cation exchange resin in the form of a metal salt whereby the unsaturated compounds are adsorbed by the resin, (b) contacting the resin with a mononuclear aromatic hydrocarbon at a temperature of 50° to 150° C. whereby the adsorbed unsaturated compounds are desorbed.

The desorption of the cation exchange resin is conveniently carried out at normal pressure.

The cation exchange resin is preferably in the form of a copper or silver salt.

The process of the invention may be used to separate unsaturated olefinic and aromatic compounds from liquid paraffin-rich hydrocarbon mixtures whose components have only slight physical and chemical differences from each other.

It will be appreciated that the initial hydrocarbon mixture may comprise only one paraffin hydrocarbon.

The unsaturated compounds being adsorbed by the cation exchange resin may be a single olefin, a mixture of olefins, a single aromatic, a mixture of aromatics, a mixture of an olefin and an aromatic, a mixture of olefins and an aromatic, a mixture of an olefin and aromatics or a mixture of olefins and aromatics. The olefins may have from 4 to 25 carbon atoms. The aromatic compounds include isocyclic and heterocyclic compounds to which the Huckel rule may be applied, excluding, however inorganic compounds which also are of an aromatic type, e.g. borazin. Examples of isocyclic carbon compounds are benzene and its derivatives, polynuclear aromatics such as naphthalene, anthracene, phenanthrene, polycyclic aromatics such as tetracene, pentacene, hexacene and the carcinogenic hydrocarbons derived from chrysene and pyrene, respectively, as well as, for example, aniline, nitrobenzene and phenol. Examples of heterocyclic carbon compounds include pyridin, furan, thiophene, quinoline and phenanthroline.

We have found that the processes disclosed in our U.S. Pat. Nos. 3,960,703 and 3,979,280 patents can be simplified if mononuclear aromatic solvents, such as benzene, toluene and xylene, are used for the desorption of the ion exchange resins loaded with the unsaturated compounds. This is surprising since the adsorptive bonding of aromatic hydrocarbons to dehydrated, macroporous cation exchange resins, in particular in the form of silver and copper salts, was known and had been used for the separation of aromatically unsaturated compounds from hydrocarbon mixtures. In view of the fact that particularly higher polycyclic aromatic compounds are relatively firmly bonded to such salts of cation exchange resins, it was not to be anticipated that they could be desorbed and displaced by mononuclear aromatics. In addition, even if the lower aromatics were able to displace the higher aromatics, it was to be expected that the desorption agent would be bonded by the exchange resin and would not be removable therefrom to a sufficient degree by means of the usual rinsing treatment with lower aliphatic hydrocarbons.

Surprisingly, it has now been found that these doubts are unfounded and mononuclear aromatic compounds such as benzene, toluene and xylene are eminently suitable as desorption agents. The cation exchange resin, which is expediently used as a fixed-bed in a separating column, can be purified prior to desorption in accordance with the invention in the usual manner by rinsing with an aliphatic hydrocarbon, for example a $C_5$–$C_{10}$ saturated aliphatic hydrocarbon, such as isooctane. Similarly, the cation exchange resin desorbed in accordance with the invention can be freed of desorption agent by rinsing with an aliphatic hydrocarbon and prepared for a new separating cycle. As the following examples will show, however, it is possible to dispense with one or both of these rinsing stages without noticeably impairing the separating results. In a particularly simple embodiment of the process of the invention rinsing of the cation exchange resin with the aliphatic hydrocarbon prior to and subsequent to desorption is dispensed with and the major portion of the desorption agent left in the resin is expelled from the cation exchange resin after desorption by passing nitrogen or another inert gas through the cation exchange resin. The thus treated cation exchange resin can be used again immediately thereafter for separating unsaturated, in particular aromatic, compounds from fresh charge material.

By using this greatly simplified technique inevitably a small amount of the desorption agent is left in the purified product. The presence of minor amounts of desorption agent in the purified product does not constitute a significant disadvantage as regards the recovery of, for example, paraffinum liquidum (liquid paraffin) or paraffinum durum (hard paraffin) or pure n-paraffin mixtures which are suitable for biogenic protein recovery, since such pure paraffin products have a considerably higher boiling point than the desorption agents used in accordance with the invention. Desorption agents, such as benzene, toluene and xylene, contained in the purified product can be easily removed therefrom by means of stripping, preferably by introducing steam, so that despite the use of aromatic desorption agents and the omission of the rinsing stages with aliphatic hydrocarbons, paraffin products can be obtained by the process of the invention, whose content of aromatic hydrocarbon compounds fully meets or is below the maximum value of the requirements of the German Manual for Pharmacists and Pharmaceutical Industry, VII Edition.

The process in accordance with the invention is preferably conducted with a cation exchange resin, which has a specific surface area of 40 to 1000 square meters per gram and a mean pore diameter of 20 to 250 A. Particularly good results were obtained with a cation exchange resin having a specific surface area of 500 to 750 $m^2/g$ and a mean pore diameter of 40 to 60 A.

The invention is illustrated by the following examples. The examples show the possibility of almost quantitatively separating aromatic compounds and other polar impurities in three types of purification, namely:

1. complete purification of deoiled slack wax (Example 2),
2. production of paraffinum liquidum (liquid paraffin) from hydrogenated white oils (Example 1 and 4), and
3. purification of n-paraffins which are produced by means of the molecular sieve or urea dewaxing processes (Example 3).

Due to the limited absorption capacity of the exchange resin with respect to unsaturated compounds, the aromatic content of the starting material is reduced by hydrogenation (of the distillate) in the production of paraffinum liquidum (as in Examples 1 and 4). This can also be achieved by deoiling to more complete purification the slack waxes derived from cold dewaxing (as in Example 2). In the case of a higher content of aromatics the adsorbent has to be regenerated frequently, thereby reducing the useful life of the resin. N-paraffins from molecular sieve dewaxing or urea dewaxing can be employed without subjecting them to pretreatment (as in Example 3). The cation exchange resin used in the examples, namely a macroporous cation exchange resin, Amberlite XE 284, has a silver content of 25 to 27% by weight, based on the dried resin, and a surface area of 380 to 440 $m^2/g$ of dried resin (determined according to the method of Brunauer, Emmett and Teller and $N_2$).

The tests in the examples are performed with an apparatus in which an adsorption tower is charged from the bottom to the top with the starting material. After adsorption is completed, the starting material is either displaced from the adsorption resin with a saturated hydrocarbon and thereafter with a mononuclear aromatic, or desorption is directly performed without a rinsing stage. The next adsorption can be directly performed after desorption, or it can be performed after rinsing with the saturated hydrocarbons.

The process parameters in the production of paraffinum liquidum (liquid paraffin), paraffinum durum (hard paraffin) and n-paraffins in the examples can be seen from Table 1. Toluene is employed as the desorption agent at a temperature of 90° C. and a space velocity of 0.5 V/V of resin/hour. Rinsing before and after desorption is performed with a saturated hydrocarbon, in this instance, isooctane.

The use of one or more aromatic compounds as the desorption agent has the advantage that the useful life of the ion exchange resin is considerably prolonged. In the case of the previously used ketone desorption agent undesired side-reactions may take place in which polycondensates, inter alia, are formed, which reduce the adsorptive capacity of the ion exchange resin. Thus, when using a ketone as a desorption agent, the resin is at only 50% of its full capacity after 10 cycles of adsorption and desorption. When using mononuclear aromatic compounds as desorption solvents, the resin is at 90% of its capacity after 10 cycles and still has 75% of its initial capacity after 40 cycles.

Tables II, III and IV show the success attainable with the present process for the almost quantitative separation of unsaturated compounds from liquid hydrocarbon mixtures. The n-paraffins from Table IV are particularly suitable as the starting product for biogenic production of protein.

Table V shows that omission of both rinsing steps, as compared with the normal method of working (adsorption, rinsing, desorption, rinsing), does not lead to reduction in separating capacity. The process conditions correspond to those given in Table I. Referring to Table V, cycles 1 to 3 were performed without rinsing with a saturated hydrocarbon (only adsorption/desorption), cycles 4 to 6 with rinsing (adsorption/rinsing/desorption/rinsing). All cycles were performed successively without changing the resin.

A comparison of cycles 1 to 3 with cycles 4 to 6 shows that they have almost the same throughput. Hence, it is clearly demonstrated that, depending on the requirements, the process can be performed with or without the rinsing stages.

The UV extinction at 275 nm was used as a measure of the aromatics content of the charge stocks and products according to "DAB" VII. In the case of charge stocks with UV extinctions in excess of 1, the values were measured after dilution with isooctane and thereafter converted.

The determination of the sulphur content was performed with the aid of X-ray fluorescence.

The results of the examples show that the present process can be particularly advantageously used for removing traces of aromatic compounds. Hydrocarbon mixtures preferably used as feed stocks preferably have an aromatics content of less than 5,000 parts per million. At a constant capacity for the aromatic compounds, the purified product amount per cycle is conversely proportional to the concentration of aromatic compounds.

TABLE I

PROCESS CONDITIONS

| | Production of paraffinum liquid (light) | Production of paraffinum durum | Purification of TSF paraffin (according to molecular sieve process) |
|---|---|---|---|
| Adsorption: | | | |
| temperature °C. | 65 | 60 | 60 |
| space velocity V/V/hr. | 0.3 | 0.5 | 0.5 |
| Rinsing with i-octane | | | |
| temperature °C. | 65 | 60 | 60 |
| space velocity V/V/hr | 0.5 | 0.5 | 0.5 |
| V(fluid)/V(resin)/cycle | 4 | 5 | 5 |
| Desorption with toluene: | | | |
| temperature °C. | 90 | 90 | 90 |
| space velocity l/l/hr | 0.5 | 0.5 | 0.5 |
| V(fluid)/V(resin)/cycle | 3 | 5 | 5 |
| Rinsing with i-octane | | | |
| temperature °C. | 65 | 60 | 60 |
| space velocity l/l/hr | 0.5 | 0.5 | 0.5 |
| V(fluid)/V(resin)/cycle | 2 | 2 | 2 |

It will be appreciated that steps 2 and 4 in this Table are not carried out in cycles 1 to 3 of Example 4.

EXAMPLE 1

Production of paraffinum liquidum (light)

The charge materials were white oils which were produced from twice extracted spindle oil distillate (boiling range: 400° to 450° C.) by refining several times with oleum (20% $SO_3$). Three white oils were employed which differed in their aromatics concentration (expressed in terms of UV extinction at 275 nm at a cuvette width of 0.5 cm).

In contrast to the adsorption treatment, the respective charge oils were subjected to conventional treatment with oleum (20% $SO_3$) in several stages, 7% of oleum being used at each stage: treatment was carried out until the treated oils achieved the specifications in accordance with DAB VII. The results are shown in Table II.

TABLE II

| | White Oil | | |
|---|---|---|---|
| | I | II | III |
| Charge material | | | |
| Extinction at 275 nm (0.5 cm) | 9.6 | 18.6 | 27.6 |
| De-aromatization V(feed//V(resin)/cycle | 10.0 | 5.0 | 2.5 |
| Extinction at 275 nm (0.5 cm) after de-aromatization | 0.75[1] | 0.75[1] | 0.75[1] |
| Treatment with 20% strength oleum | 3 × 7% | 4 × 7% | 5 × 7% |
| Extinction at 275 nm (0.5 cm) | | | |

TABLE II-continued

| | White Oil | | |
|---|---|---|---|
| | I | II | III |
| after oleum treatment | 0.41 | 0.48 | 0.69 |

[1]result after 5th cycle

EXAMPLE 2

Production of high-purity paraffinum durum according to the DAB VII (Deutsche Arzneibuch VII—German Manual for Pharmacists and Pharmaceutical Industry)

Charge material: slack wax (from the solvent neutral oil of the SAE Class 5), pretreated with 0.5% by weight of tonsil, 2 to 3% by weight of oil content.

The average charge for 10 cycles amounted per cycle of 14 kg of pure paraffin/kg of resin. The charge material and end product has the analytical data shown in Table III.

TABLE III

| | Charge material | Purified paraffin |
|---|---|---|
| Sulphur ppm | 300 | 20 |
| Ext. at 275 nm (2 cm cuvette) 0.5 g of paraffin in 50 ml of isooctane (DAB VII specifications) | 1.8 | 0.25* |

*The maximum extinction of 0.6 permissible per se in accordance with DAB could not be fully used as the required sulphuric acid reaction (according to DAB VII) does not take place in accordance with the specifications when the extinction value exceeds 0.25.

EXAMPLE 3

Purification of n-paraffins from the molecular sieve process

The process conditions are given in Table I.

The charge product and the end product had the analytical data shown in Table IV below.

TABLE IV

| Charge materials | | | End products after adsorptive purification | | |
|---|---|---|---|---|---|
| carbon no. range | sulphur ppm | ext. at 270nm (1cm) | V/V/cycle | ext. at 270nm (1cm) | sulphur ppm |
| $C_{10}$–$C_{13}$ | 10 | 12.0 | 26.0 | 0.1 | 2 |
| $C_{10}$–$C_{13}$ | 7 | 15.0 | 24.5 | 0.1 | 2 |
| $C_{13}$–$C_{16}$ | 56 | 100 | 8.0 | 0.45 | 3 |

For the purpose of comparison with adsorption treatment, the $C_{13}$–$C_{16}$ was treated with 33% by weight of oleum (4.5% $SO_3$). The extinction in the case of the treated product was 0.45 at 270 nm (cuvette 1 cm).

EXAMPLE 4

Production of paraffinum liquidum (PL)

The same charge material was used as in the Example I except that it has a somewhat lower content of aromatic compounds (cf. white oil I).

The product after de-aromatization: extinction at 275 nm (0.5 cm)=0.8 (in accordance with DAB VII for PL).

Results are shown in Table V below.

TABLE V

| Cycle | V(feed)/V(resin)/cycle |
|---|---|
| 1 | 11.2 |
| 2 | 10.9 |
| 3 | 10.9 |
| 4 | 10.8 |
| 5 | 10.8 |
| 6 | 10.9 |
| Cycles 1 to 3: | without rinsing |
| Cycles 4 to 6: | with rinsing before and after desorption. |

We claim:

1. A process for the separation of unsaturated hydrocarbon compounds from a liquid, paraffin-rich hydrocarbon mixture comprising:

(a) contacting the hydrocarbon mixture with a dehydrated, macroporous cation exchange resin in the form of a metal salt whereby the unsaturated compounds are adsorbed by the resin, (b) contacting said dehydrated macroporous cation exchange resin containing adsorbed unsaturated compounds with a mononuclear aromatic hydrocarbon at a temperature of 50° to 150° C. whereby the adsorbed unsaturated compounds are desorbed.

2. A process according to claim 1 wherein the cation exchange resin is in the form of a copper or silver salt.

3. A process according to claim 1 wherein the mononuclear aromatic hydrocarbon is benzene, toluene or xylene.

4. A process according to claim 1 wherein the unsaturated compounds are an olefin or a mixture of olefins.

5. A process according to claim 1 wherein the unsaturated compounds are an aromatic compound or mixture of aromatic compounds.

6. A process according to claim 1 wherein the unsaturated compounds are a mixture of (a) an olefin and an aromatic compound, (b) olefins and an aromatic compound, (c) an olefin and aromatic compounds or (d) olefins and aromatic compounds.

7. A process according to claim 1 including the following additional step subsequent to step (b):

(c) contacting the resin with an inert gas whereby a major portion of the aromatic hydrocarbon is removed from the resin.

8. A process according to claim 7 wherein the inert gas is nitrogen.

9. A process according to claim 7 wherein steps steps (a), (b) and (c) are repeated subsequent to step (c).

10. A process according to claim 9 wherein subsequent to step (a) the hydrocarbon mixture is subjected to a steam stripping whereby the mononuclear aromatic hydrocarbon contained in said mixture is removed, said mononuclear aromatic hydrocarbon having been the desorption agent in the prior step (b) and retained in the resin at the conclusion of the prior step (c).

11. A process according to claim 1 wherein prior to and subsequent to step (b) the resin is rinsed with a $C_5$–$C_{10}$ saturated aliphatic hydrocarbon.

12. A process according to claim 1 wherein the resin has a specific surface area of from 40 to 1000 square meters/gram and a mean pore diameter of from 20 to 250 A.

13. The process of claim 1 in which the material charged into contact with the dehydrated macroporous cation exchange resin in the step (a) consists essentially of hydrocarbons.

* * * * *